United States Patent [19]

Matthews

[11] 4,087,045

[45] May 2, 1978

[54] STACK DAMPER CONTROL SAFETY INTERLOCK WITH LOCKOUT PREVENTION

[75] Inventor: Russell Byron Matthews, Goshen, Ind.

[73] Assignee: Johnson Controls, Inc., Milwaukee, Wis.

[21] Appl. No.: 726,952

[22] Filed: Sep. 27, 1976

[51] Int. Cl.[2] ..... F23N 0/00; G05D 23/00

[52] U.S. Cl. ..... 236/1 G; 110/163; 126/286

[58] Field of Search ..... 236/1 G; 110/163; 126/46, 285, 286

[56] References Cited

U.S. PATENT DOCUMENTS

| | | | |
|---|---|---|---|
| 2,155,642 | 4/1939 | Dewey | 236/1 G |
| 3,086,583 | 4/1963 | Reichow | 431/46 |
| 3,449,055 | 6/1969 | Blackett | 431/46 |
| 3,986,813 | 10/1976 | Hewitt | 431/46 |

FOREIGN PATENT DOCUMENTS

| | | | |
|---|---|---|---|
| 737,709 | 7/1966 | Canada | 236/1 G |

*Primary Examiner*—William E. Wayner
*Assistant Examiner*—R. J. Charvat
*Attorney, Agent, or Firm*—Emrich, Root, O'Keeffe & Lee

[57] ABSTRACT

A control arrangement for a heating system including a furnace having a fuel-fired burner apparatus and a vent stack with a motor driven damper plate for opening and closing the stack, includes an interlock switch which provides a safety interlock between fuel supply valves of the system and first and second limit switches which control the energization of a drive motor for the damper plate and effect energization of the fuel supply valves of the system, permitting the fuel valves to operate only when the damper plate is in the open position and preventing energization of the fuel valves in the event of a malfunction of either of the limit switches. The interlock switch also permits recycling of the system in the event of a momentary power interruption. The control arrangement may include a stack mounted heat sensor switch which interrupts the energizing path for the fuel supply valves in the absence of heat from the main burner within a predetermined interval of time.

20 Claims, 2 Drawing Figures

R3
20
FLAME SENSING CKT
TO FLAME SENSOR 65
L3
L4
62
T1
61
18
R3C
14'
12'
L1'
R2A
R3A
IGN.
16
R3B
R2
60
RIB
CB3
MOTOR
32
54
55
CB1
34
CB2
56
44
43
CB
38
30
L1
L2
10
RIA
59
R1
57
THS
RIC
CA2
CA1
CA3
41
42
CA
36
TO FUEL SOURCE
PILOT OUTLET
11
PILOT VALVE 12
VENT STACK
24
22
21
TO FLAME SENSING CKT.
65
51
MAIN BURNER 13
MAIN VALVE 14
52

STACK DAMPER CONTROL SAFETY INTERLOCK WITH LOCKOUT PREVENTION

BACKGROUND OF THE INVENTION

1. Field of the Invention

This invention relates to heating systems including furnaces having fuel-fired burners, and, more particularly, to a control arrangement which provides a safety interlock between a stack damper control apparatus and fuel supply apparatus for such systems.

2. Description of the Prior Art

Heating systems employing furnaces having fuel-fired burners require a vent stack to conduct combustion products away from the burner. Automatically controlled stack dampers are generally used in the ventilation stacks to permit the stacks to be closed when the furnace is not operating to minimize heat losses when the furnace is not operating. However, for safe operation, it is necessary that the stack damper be open in advance of each operation of the burner. Accordingly, systems in which automatic dampers are used generally include a control arrangement which provides an interlock between the damper control mechanism and fuel supply apparatus of the system to assure that the damper is fully open before the burner operates and is closed after the completion of the operation of the burner.

In one known arrangement in which a primary burner control is conditional on and subsequent to the opening of a stack damper, a drive motor is energized in response to a request for heat to drive the damper to an open position, and limit switches complete the burner circuit and deenergize the drive motor when the damper reaches the fully open position. The drive motor is reenergized at the end of the heat run to move the damper to the closed position, a further switch deenergizing the motor when the damper reaches the closed position. Movement of the damper from the fully open position permits a limit switch to interrupt the burner circuit. A time lag is provided between the interruption of the burner circuit and the closing of the damper to allow volatiles to be purged from the furnace following operation of the burner.

When operating properly, systems such as the type referred to above provide the desired interlock between the stack damper and the fuel supply apparatus. However, under certain failure conditions, such as the welding together of contacts of the limit switches, or, when cam-operated switches are used, the cams becoming loose and shifting out of place, the fuel supply valves may be energized while the vent stack is closed. Moreover, due to the interlock arrangement, the system may become locked out following a momentary power interruption, an undesirable condition.

Therefore, it would be desirable to have a control arrangement for use in a heating system which provides a safety interlock between a stack damper control apparatus and fuel supply apparatus of the system which prevents operation of the fuel supply apparatus whenever the damper is in a position other than a fully open position, or in the event of an unsafe failure of the control apparatus, and which prevents lock out of the system following a momentary power interruption.

SUMMARY OF THE INVENTION

It is therefore an object of the present invention to provide a control arrangement for a heating system which provides a safety interlock between the stack damper control apparatus and fuel supply apparatus of the system.

Another object of the invention is to provide a heating system including a motor actuated damper apparatus which is interlocked with the fuel valves of the system to permit operation of the fuel valves only when the damper is in a fully open position.

Another object of the invention is to provide a control arrangement for a stack damper apparatus and fuel supply apparatus of a heating system, which prevents lock out of the system following a momentary power interruption.

Yet another object of the invention is to provide a control arrangement for a heating system including stack damper control apparatus, which prevents the operation of fuel supply valves of the system in the event of an unsafe failure of the stack damper control apparatus.

These and other objects are achieved by the present invention which has provided a control arrangement for use in a heating system and which provides a safety interlock between a fuel supply means which supplies fuel to a burner apparatus of the system for combustion to provide heat, and a stack damper control means which controls the positioning of a stack damper plate which is pivotally mounted within a vent stack. The damper plate is normally maintained in a first position to close the vent stack when the system is deactivated, and is rotatable to a second position to open the vent stack when the system is activated. The control arrangement comprises switching means operable when energized to prepare an energizing path for the fuel supply means, first limit switch means for preparing an energizing path for the switching means and drive motor whenever the damper plate is at the first position, and activate means responsive to a request for heat to effect the energization of the switching means and the drive motor over the first limit switch means to permit the damper plate to be driven towards the second position. The first limit switch means is operable when the damper plate has been driven to the second position to deenergize the drive motor and to complete the energizing path for the fuel supply means. The activate means is operable when the heating demand has been met to deenergize the fuel supply means and the switching means, permitting the drive motor to be reenergized to drive the damper plate to the first position. A second limit switch means is operable when the damper plate has been driven to the first position to effect the deenergization of the drive motor.

The safety interlock between the fuel supply means and the stack damper control means is provided by the first and second limit switch means and the switching means. In accordance with a disclosed embodiment, the switching means is embodied as a switching device, such as a relay, and the first and second limit switch means comprise cam operated switches which are coupled to a drive shaft of the motor. The interlock relay is energized over the first and second limit switches at the start of each heating cycle and operates to close associated contacts which are connected in the energizing path for the fuel supply means. The limit switches permit the energization of the drive motor causing the damper plate to be driven to the open position and also interrupt the energizing path for the interlock relay, which is maintained by a holding path provided by further contacts of the relay. When the damper plate has been driven to the fully open position, the first limit switch operates to complete the energizing path for the fuel supply means. In the event that the interlock relay fails to operate at the start of a heating cycle, such as due to a malfunction of either limit switch or of the interlock relay itself, the energizing path for the fuel supply means is maintained interrupted, even though the damper plate is at the open position and the first limit switch operates to complete a portion of the energizing path.

Thus, the control arrangement of the present invention not only provides for the energization of the fuel supply means only when the damper plate is at the fully open position, but also guards against unsafe failure of one or both limit switches, preventing the energization of the fuel supply means in the event of such occurrence.

In accordance with a feature of the invention, the interlock relay has further contacts connected in the return drive path for the drive motor, and is responsive to the activate means to complete the return drive path when the heat demand has been met, permitting the drive motor to be reenergized to drive the damper plate to the first position. This feature also prevents the heating system from becoming locked out in the event of a power interruption during a heating cycle.

In the event of a power interruption during a heating cycle, the interlock relay is deenergized, permitting the drive motor to be reenergized when the power is restored, so that the damper plate is returned to the closed position. When the damper reaches the closed position, operation of the limit switches permits a new heating cycle to be initiated.

In an application in a pilot-ignition type heating system, including a pilot valve and a main valve, and an electronic flame sensing means, an interlock may be provided between the fuel supply means and the flame sensing means to permit the interruption of the energizing path for the fuel valves in the event of a malfunction of the flame sensing means which would otherwise permit fuel to be supplied to the main burner apparatus in the absence of a flame. In accordance with a further feature of the invention, the flame sensing means is energized in response to the activate means in response to a request for heat, so that in the event of a malfunction in the flame sensing means, the time that is required for the drive motor to drive the damper plate to the fully open position affords sufficient delay for the flame sensing means to interrupt the energizing path before the limit switch operates to apply power to the energizing path for the fuel valves.

In accordance with another feature of the invention, the system may also include a heat sensor switch means which is responsive to the activate means to permit the energization of the fuel supply means over the energizing path, the heat sensor switch means being operable in the absence of heat from the main burner apparatus within a predetermined time following the energization of the fuel supply means to interrupt the energizing path. In accordance with a disclosed embodiment, the heat sensor switch means includes normally open switch contacts which are connected in the energizing path for the fuel supply means, and a heater element which is energized over one of the limit switch means responsive to the activate means to cause the contacts to close. The heater element is deenergized when the limit switch means is operated whereby the heat sensor switch maintains the contacts closed responsive to heat from the main burner apparatus. In the absence of heat from the main burner apparatus within a predetermined time after the heating element is deenergized, the heat sensor switch operates to open the contacts thereby deenergizing the fuel supply means.

The use of the heat sensor switch guards against unsafe conditions, such as a simultaneous failure where, following a successful start-up, an unsafe failure occurs in the flame sensing circuit which is then followed by a flame-out, which would other wise permit fuel to be supplied to the main burner apparatus without ignition.

DESCRIPTION OF PREFERRED EMBODIMENTS

Figure 1:
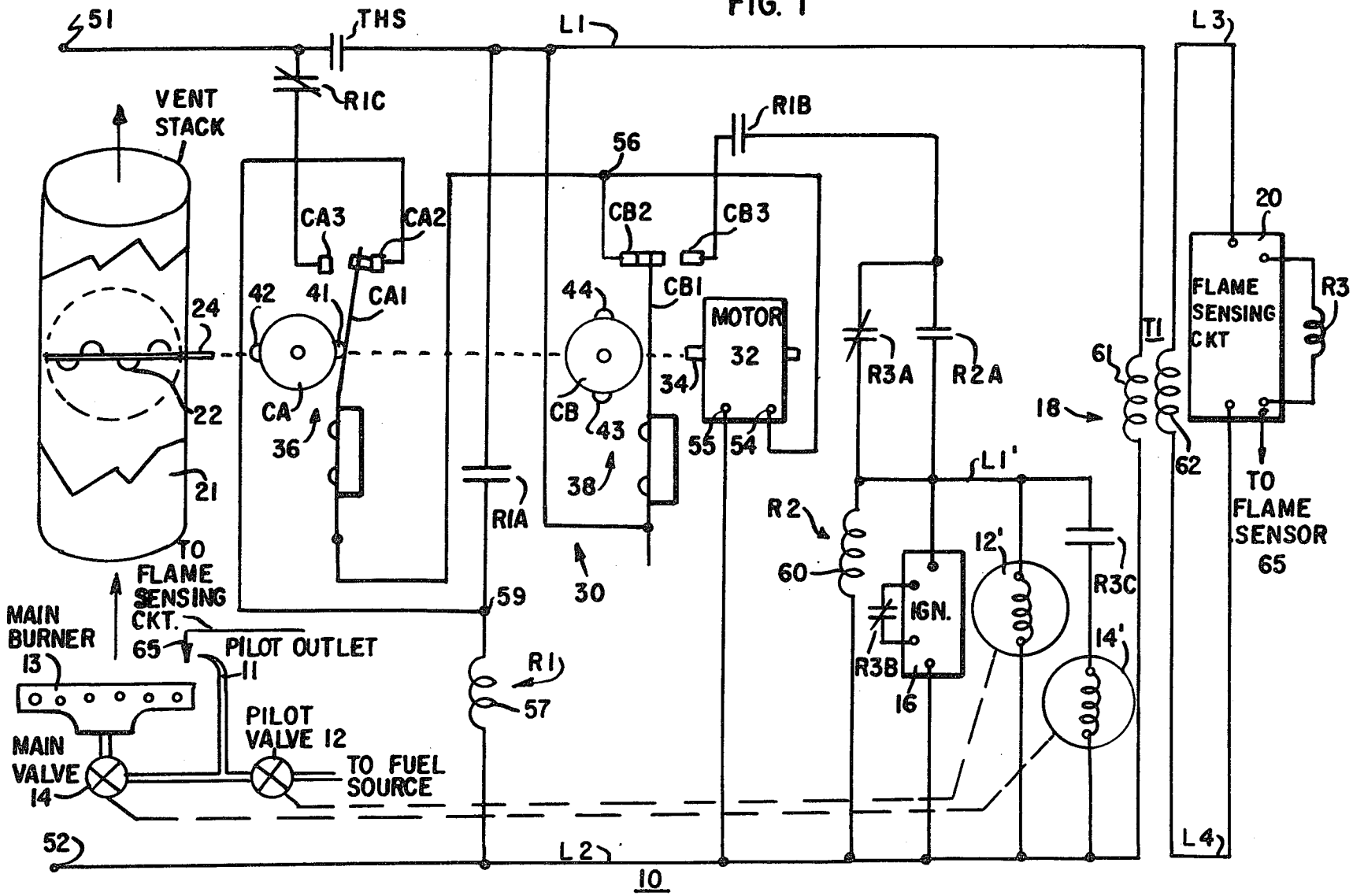
FIG. 1 is a schematic circuit diagram for a control arrangement for a heating system provided in accordance with one embodiment of the invention; and, FIG. 2 is a schematic circuit diagram for a control arrangement for a heating system provided in accordance with a second embodiment of the invention.

Referring to the drawings, FIG. 1 is a simplified representation of a heating system 10 employing a control arrangement provided by the present invention. In the exemplary embodiment, the heating system 10 is of the pilot ignition type. The system 10 includes a fuel-fired heating apparatus having a pilot outlet 11 and a main burner 13, a pilot valve 12, a main valve 14, and an igniter circuit 16, the operation of which are controlled by a fuel ignition control circuit 18 which includes a flame sensing circuit 20 and a relay R2. The pilot valve 12 is operable when energized to supply fuel to the pilot outlet 11 for ignition by sparks provided by the igniter circuit 16 to provide a pilot flame. The main valve 12 is operable under the control of the flame sensing circuit 20 to supply fuel to the main burner 13 for ignition by the pilot flame to establish a flame at the main burner 13 for providing heat for the system.

The heating system 10 further includes a vent stack 21 for venting combustion products away from the main burner 13 when the main burner is lit. A stack damper plate 22 is pivotally mounted within the stack by way of a shaft 24 for movement between closed and open positions under the control of a stack damper control circuit 30, including a drive motor 32. The shaft 24 is mechanically linked to a drive shaft 34 of the drive motor 32 which is operable when energized to drive the damper plate 22 between the closed and open positions.

The damper plate 22 is normally maintained in the closed position, as illustrated in FIG. 1, when the system 10 is deactivated, so that the vent stack 21 is closed, preventing heat loss via the vent stack 21. In response to a request for heat, the stack damper control circuit 30 energizes the motor 32 to permit the damper plate 22 to be driven from the closed position to the open position, represented by the dotted line in FIG. 1 to permit combustion products to be vented away from the main burner. The stack damper control circuit 30 includes a first limit switch 38 which effects the deenergization of the motor 32 when the damper plate 22 reaches the open position. When the heating demand has been met, the stack damper control circuit 30 reenergizes the drive motor 32 to permit the damper plate 22 to be driven to the closed position. A second limit switch 36 effects deenergization of the motor 32 when the damper plate 22 reaches the closed position.

The limit switches 36 and 38 each comprise cam actuated switches, the operation of which is controlled by way of cams CA and CB. The cams CA and CB are mechanically linked to the shaft 34 of the motor 32. The limit switch 36 includes a resilient switch arm CA1, which is movable by way of cam CA, and a pair of fixed contacts CA2 and CA3. Cam actuator portions 41 and 42 are disposed at diametrically opposed positions along the periphery of the cam CA. As shown in FIG. 1, actuator portion 41 maintains switch arm CA1, which is biased to normally engage contact CA3, in engagement with contact CA2 when the damper plate 22 is in the closed position. When the cam CA is rotated approximately 5°, the actuator portion 41 disengages the switch arm CA1 which then moves out of engagement with contact CA2 and into engagement with contact CA3. When the cam CA has been rotated through 180°, actuator portion 42 engages the switch arm CA1, moving the switch arm CA1 out of engagement with contact CA3 and into engagement with contact CA2.

Similarly, limit switch 38 includes a resilient switch arm CB1, which is movable by cam CB, and fixed contacts CB2 and CB3. Cam CB has cam actuator portions 43 and 44, which are normally disengaged from the switch arm C1B permitting the switch arm CB1 to engage contact CB2 when the damper plate 22 is in the closed position. The cam actuator portion 43, for example, causes the switch arm CB1 to be moved out of engagement with contact CB2 and into engagement with contact CB3 with 90° of rotation of the cam CB to a position corresponding to the fully open position for the damper plate 22.

Contacts CB1 and CB2 of limit switch 38 provide an energizing path for the drive motor 32 when contacts THS close in response to a request for heat, and deenergize the motor 32 when the damper plate 22 reaches the fully open position. Contacts CB1 and CB2 of limit switch 38, along with contacts CA1 and CA2 of limit switch 36, provide an energizing path for an interlock relay R1. Contacts CB1 and CB3 of limit switch 38 provide an energizing path for the fuel ignition control circuit 18, and contacts CA1 and CA3 of limit switch 36 provide a return drive energizing path for the motor 32 and deenergize the motor 32 when the damper plate 22 reaches the closed position.

In accordance with the present invention, the stack damper control circuit 30 is interlocked with the fuel ignition control circuit 18 by way of the limit switches 36 and 38 and the interlock relay R1 which permit energization of the fuel ignition control circuit 18 only when the damper plate 22 is in the fully open position. The interlock relay R1 is energized over the limit switches 36 and 38 following the operation of thermostatically controlled contacts THS in response to a request for heat. Relay R1 is operable when energized to close associated contacts R1A which provide a holding path for the relay R1. Also, contacts R1B of relay R1 are closed preparing an energizing path for the fuel ignition control circuit 18. When the damper plate 22 has been rotated to the fully open position, limit switch 38 operates whereby an energizing path is completed over limit switch 38, permitting power to be applied to the fuel ignition control circuit 18. Limit switch 38 also deenergizes the motor 32.

When power is applied to the fuel ignition control circuit 18, the pilot valve 12 and the igniter circuit 16 are energized to establish a pilot flame. When a pilot flame is established, the flame sensing circuit 20 effects the energization of the main valve 14 through the operation of an associated relay R3, permitting fuel to be supplied to the main burner apparatus for ignition by the pilot flame.

The fuel ignition control circuit 18 includes an interlock relay R2 which prevents operation of the fuel valves 12 and 14 in the event of a malfunction in the flame sensing circuit 20 which would otherwise permit operation of the main valve 14 in the absence of a pilot flame. The fuel ignition control circuit 18 is initially energized over normally closed contacts R3A of relay R3, to permit operation of the pilot valve 12 and the energization of relay R2. When relay R2 operates, a holding path is provided over contacts R2A of the relay R2. The fuel ignition control circuit 18 is maintained energized over the holding path provided by contacts R2A of relay R2 when relay R3 operates to open contacts R3A when a pilot flame is established. Failure of a relay R2 to operate prior to operation of relay R3 permits the deenergization of the fuel ignition control circuit 18. Also, relay R2 is prevented from operating, preventing operation of the main valve 14 whenever contacts R3A are open at the time limit switch 38 operates to apply power to the fuel ignition control circuit 18.

When the heating demand has been met following a successful heating cycle, the thermostatically controlled contacts THS open, causing relay R2 and the fuel valves 12 and 14 to be deenergized. In addition, relay R1 also drops out, closing contacts R1C which complete an energizing path for the motor 32 over limit switch 36, permitting the damper plate 22 to be driven to the closed position. Limit switch 36 operates to deenergize the motor 32 when the damper plate reaches the closed position.

The motor 32 operates at a specific speed and provides sufficient time for the interlock circuit to operate at the start of a heating cycle. The timed closing of the damper plate 22 at the end of each heating cycle allows combustion products to be vented from the vent stack 21 before the damper plate 22 is returned to the closed position.

The position of the damper plate 22 is mechanically interlocked with limit switch 38, allowing actuation of the limit switch 38 only when the damper plate 22 is fully open. This provides a safety aspect such that it is impossible to manually operate the damper plate 22 to any position other than fully open and simultaneously cause the fuel valves 12 and 14 to be electrically actuated. The limit switches 36 and 38 are electrically interconnected so that the energization of relay R1 is prevented in the event of a malfunction of either switch, thereby maintaining the fuel ignition control circuit 18 deenergized. Also, the interlock afforded by relay R1 and limit switches 36 and 38 prevents the system 10 from being locked out following a power interruption during a heating cycle.

Moreover, the proper operating sequence of the relays R1-R3 and the limit switches 36 and 38 must be maintained in order to effect the energization of the fuel ignition control circuit 18, permitting the fuel valves 12 and 14 to operate as will be shown hereinafter.

Considering the heating system 10 in more detail, power is supplied to the system 10 over input terminals 51 and 52 thereof which are connectable to a 25 VAC source. Terminal 51 is connected over normally open thermostatically controlled contacts THS to a conductor L1, and terminal 52 is connected directly to a further conductor L2. When the damper plate 22 is in the closed position, the motor 32 is connected between conductors L1 and L2 over limit switch 38 which has its movable arm CB1 connected to conductor L1 and its fixed contact CB2 connected to one terminal 54 of the motor 32, which has a second terminal 55 connected to conductor L2, permitting the motor 32 to be energized when contacts THS close.

Contact CB2 of limit switch 38 is also connected at point 56 to the movable switch arm CA1 of limit switch 36. Contact CA2 of switch 36 is connected to one side of the operate coil 57 of relay R1 at point 59, the other side of which is connected to conductor L2. Accordingly, the operate coil 57 of relay R1 is also connected between conductors L1 and L2 for energization whenever contacts THS close.

Relay R1 has normally contacts R1A connected between point 59 and conductor L1 to provide a holding path for relay R1, and normally closed contacts R1C connected between input terminal 51 and fixed contact CA3 of limit switch 36 for providing a return drive energizing path for the motor 32 at the end of each heating cycle. Relay R1 has further normally open contacts R1B connected in series with normally closed contacts R3A of relay R3 between fixed contact CB3 of limit switch 38 and a conductor L1', to supply power to the fuel ignition control circuit 18 when the limit switch 38 is operated to move its switch arm CB1 into engagement with contact CB3. Relay R1 is a 3-pole, double throw relay, with contacts R1B and R1C employing a common armature of the relay R1. Thus, should contacts R1B become welded together, contacts R1C cannot reclose.

Referring to the fuel ignition control circuit 18, the operate solenoid 12' of the pilot valve 12, igniter 16 and the operate coil 60 of relay R2 are connected in parallel between conductors L1' and L2'. The operate solenoid 14' of the main valve 14 is connected between conductors L1' and L2 over normally open contacts R3C of relay R3. Relay R2 has normally open contacts R2A, connected in shunt with contacts R3A to provide a holding path for the pilot valve solenoid 12' and the main valve solenoid 14' when relay R3 operates.

The igniter circuit 16, may, for example, be the type disclosed in the U.S. Patent Application, Ser. No. 698,161, of G. E. Dietz, which is entitled, "Fuel Ignition System Including An Igniter Which Provides A Lingering Spark." The operation of the igniter is disclosed in detail in the referenced patent application. Briefly, when power is applied to the fuel ignition control circuit 18, the igniter circuit 16 is energized to provide ignition sparks for igniting fuel supplied to the pilot outlet. When a pilot flame is established, the relay R3 operates, opening contacts R3B, which are connected in an enabling circuit for the igniter circuit, to thereby disable the igniter circuit 16. The igniter circuit 16 continues to provide sparks for a predetermined time following the operation of the relay R3, assuring ignition of the fuel in the event of a malfunction in the flame sensing circuit 20 which allows relay R3 to operate in the absence of a flame.

The flame sensing circuit 20 is energized over a transformer T1, which has a primary winding 61 connected between conductors L1 and L2, and a secondary winding 62 connected between conductors L3 and L4 which are connected to input terminals of the flame sensing circuit 20. The flame sensing circuit 20 may be the type disclosed in U.S. Pat. 3,902,839 of Russell B. Matthews, which was issued on September 2, 1975. As disclosed in detail in such patent, the flame sensing circuit 20 includes a flame sensor 65 which is disposed in proximity to the pilot outlet and is responsive to a pilot flame to effect the operation of relay R3 of the flame sensing circuit 20. The relay R3 operates to open contact R3A to interrupt the energizing path to conductor L1' for the pilot valve solenoid and the igniter 14, which are then maintained energized over the holding path provided by contacts R2A of relay R2. Relay R3 also opens contacts R3B to disable the igniter 16 and closes contacts R3C to complete the energizing path for the main valve solenoid 14' between conductor L1' and L2. Relay R3 is a double-pole, double throw relay, with contacts R3A and R3C employing a common armature. Thus, if contacts R3C become welded together, contacts R3A cannot reclose when relay R3 is deenergized.

OPERATION

For the purpose of illustrating the operation of the control arrangement for the heating system 10, it is assumed initially that the system 10 is deactivated with the damper plate 22 in the fully closed position, and that the limit switches 36 and 38 are operated to the positions shown in FIG. 1. In response to a request for heat, contacts THS close, extending power to conductor L1 for energizing the drive motor 32 over contacts CB1 and CB2 of switch 38, and for energizing relay R1 over contacts CB1 and CB2 of switch 38, and contacts CA1 and CA2 of switch 36. The flame sensing circuit 20 is also energized over transformer T1.

When relay R1 operates, contacts R1A are closed providing a holding path for the relay R1 between conductors L1 and L2, and contacts R1C are opened, interrupting the return drive energizing path for the motor 32. Also, contacts R1B of relay R1 are closed, preparing an energizing path for the pilot valve solenoid 12' and the igniter 16 which extends from fixed contact CB3 over contacts R3A to conductor L1'. At this time, the energizing path is interrupted by limit switch 38 since switch arm CB1 is still engaging contact CB2.

When the motor 32 is energized, the motor shaft 34 rotates, moving the damper plate 22 toward the open position. Cams CA and CB are also driven, and when cam CA has been rotated approximately 5°, CA1 is moved out of engagement with contact CA2, and into engagement with contact CA3 to prepare a return drive energizing path for the motor 32, and to interrupt the energizing path for relay R1 which is maintained energized over its contacts R1A.

When the damper plate 22 has been moved to the fully open position, cam CB has been rotated approximately 90°, permitting contact CB1 to move out of engagement with contact CB2, deenergizing the motor 32, and engaging contact CB3, completing the energizing path for the pilot valve solenoid 12' and the igniter 16 from conductor L1 over contacts CB1 and CB3 of limit switch 38, contacts R1A of relay R1 and contacts R3A of relay R3 to conductor L1'. When the pilot valve 12 operates, fuel is supplied to the pilot outlet 11 for ignition by sparks provided by the igniter 16. Relay R2 is also energized when power is applied to conductor L1', and operates to close contacts R2A to provide a holding path in shunt with contacts R3A.

When a pilot flame is established, the flame sensing circuit 20, senses the pilot flame and effects energization of relay R3. When relay R3 operates, contacts R3A are opened, interrupting the energizing path for the pilot valve solenoid 12' and the igniter 16 which are maintained energized over the holding path provided by contacts R2A of relay R2. In addition, contacts R3B of relay R3 are opened, disabling the igniter 16, and contacts R3C are closed, energizing the main valve solenoid 14', supplying fuel to the main burner 13 for ignition by the pilot flame to provide heat to satisfy the heating demand for the system 10.

When the heating demand has been met, contacts THS open, interrupting the supply of power to conductor L1, causing the deenergization of the fuel valves 12 and 14, permitting the main burner flame and the pilot flame to be extinguished. The flame sensing circuit 20, and relay R2 and relay R1 are also deenergized, and when relay R1 drops out, contacts R1C close completing the return drive energizing path for the motor 32 over contacts CA1 and CA3 of limit switch 36 for energizing the motor 32 to dirve the damper plate 22 to the fully closed position. As the motor shaft 34 is driven, cams CA and CB are rotated. When cam CB has been rotated approximately 5°, switch arm CB1 is moved out of engagement with contact CB3, interrupting the energizing path for the fuel ignition control circuit 18, and into engagement with contact CB2. When the damper plate 22 reaches the closed position, cam CA has been rotated approximately 90°, and contacts CA1 and CA3 open, deenergizing the motor 32. Also, contact CA1 reengages contact CA2, preparing an energizing path for relay R1. Accordingly, the system 10 is prepared for the next heating cycle.

In the event of a power interruption while the damper plate 22 is open, contact CB1 is engaging contact CB3, and contact CA1 is engaging contact CA3 such that the power interruption causes relay R1 to drop out. When the power is restored, the motor 32 is reenergized over contacts R1C and limit switch 36, causing the damper plate 22 to move toward the closed position. After approximately 5° of travel of the cam contacts CB1 disengages contact CB3 and engages contact CB2. When the damper reaches the closed position, contact CA1 disengages contact CA3 and engages contact CA2. The motor 32 does not stop, however, because the operation of limit switch 38 completes an energizing to the motor 32 and limit switch 36 provides an energizing circuit for relay R1, and the damper plate 22 rotates to the open position and stops, thereby starting a normal cycle.

SAFETY ASPECTS

As indicated above, the proper sequencing of relays R1-R3 is required to enable the fuel valves 12 and 14 to operate. That is, relay R1 must operate before relays R2 and R3 operate, and relay R2 must operate before relay R3 operates.

For a failure of relay R1, such as an open coil 57, then when contacts THS close, relay R1 remains disabled and contacts R1B remain open preventing energization of the fuel ignition control circuit 18. The motor 32 will run continuously as long as contacts THS remain closed. Also, should contacts R1B become welded closed, then contacts R1C remain open at the end of a heating cycle, preventing the damper plate 22 from being returned to the closed position.

Moreover, for a failure in the flame sensing circuit 20 which permits relay R3 to be operated in the absence of a flame, then upon the closure of the contacts THS, relay R3 operates, opening contacts R3A and the energizing path for the relay R2 and the pilot valve 12 is interrupted, preventing operation of the pilot valve 12 and the system 10 is maintained in a lock out condition.

In the event of a failure condition following a successful start up, such as the welding together of the contacts R3C which control the operation of the main valve 14, then when the heating demand has been met, and contacts THS open, the pilot valve 12 and the main valve 14 are deenergized, extinguishing the flame. The flame sensing circuit 20 responds to the loss of flame to deenergize relay R3. However, since contacts R3C are welded together, contacts R3A cannot reclose since such contacts employ a common armature of the relay R3. Accordingly, when contacts THS close on the next call for heat, the energizing path for the fuel ignition control circuit 18 is interrupted since contacts R3A are open. Thus, the pilot valve 12 and the main valve 14 are maintained deenergized.

The stack damper control circuit 30 also provides fail safe operation for the stack damper 22 and the fuel ignition control circuit 18. For example, in the event CB1 of limit switch 38 becomes welded to fixed contact CB2, then, following activation of the system 10 through operation of contacts THS, the motor 32 continues to run, periodically moving the damper plate 22 between open and closed position. However, the pilot valve 12 and main valve 14 remain deenergized because movable contact CB1 cannot engage fixed contact CB3 to complete the energizing path to the fuel ignition control circuit 18. Also, should contact CB1 of limit switch 38 become welded to fixed contact CB3, then, on the next call for heat, the motor 32 cannot be energized because the energizing path provided over contacts CB1 and CB2 is interrupted. Relay R1 is also prevented from operating so that contacts R1B remain open, preventing the application of power to the fuel ignition control circuit 18.

Considering limit switch 36, should contact CA1 become welded to contact CA3, the motor 32 continues to run. However, relay R1 cannot be energized due to the interruption of its energizing path over contacts CA1 and CA2, preventing the application of power to the fuel ignition control circuit 18. Should the contacts CB3 and CA3 become welded to respective movable contacts CB1 and CA1, the motor 32 continues to run and relay R1 remains deenergized. Accordingly, contacts R1B of relay R1 remain open, preventing energization of the fuel ignition control circuit 18.

In the event contact CB2 and contact CA2 are welded to respective movable contact members, CB1 and CA1, the motor 32 runs continuously whenever the thermostat contact THS is closed. The ignition circuit remains deenergized since contact CB3 remains open. When the thermostat opens, the damper does not return to the closed position.

In the event contact CA3 of limit switch 36 and contact CB2 of limit switch 38 become welded to respective movable contacts CA1 and CB1, the motor 32 runs continuously. However, relay R1 is maintained deenergized, preventing the closing of contacts R1b, and movable contact CB1 cannot engage contact CB3, preventing energization of the fuel ignition control circuit 18.

Generally speaking, the limit switches 36 and 38 are electrically interlocked so that if a contact on either one of the switches becomes welded closed, or one of the cams CA or CB becomes physically shifted in position, the energizing circuit for relay R1 is interrupted, cutting off all power to the fuel ignition control circuit 18. Thus, if either of the cams CA or CB becomes loose or shifts out of position, the fault is similar to that of welded contacts previously described, that is, the contacts being closed whenever they are supposed to be open.

Also, since the flame sensing circuit 20 is energized in the response to the closing of thermostatically controlled contacts THS, the delay provided by motor 32 in closing contacts CB1 and CB3 allows time for relay R3 to energize under a fault condition to open contacts R3A, preventing energization of the relay R2 and thus the ignition control circuit 18.

SECOND EMBODIMENT

Figure 2:
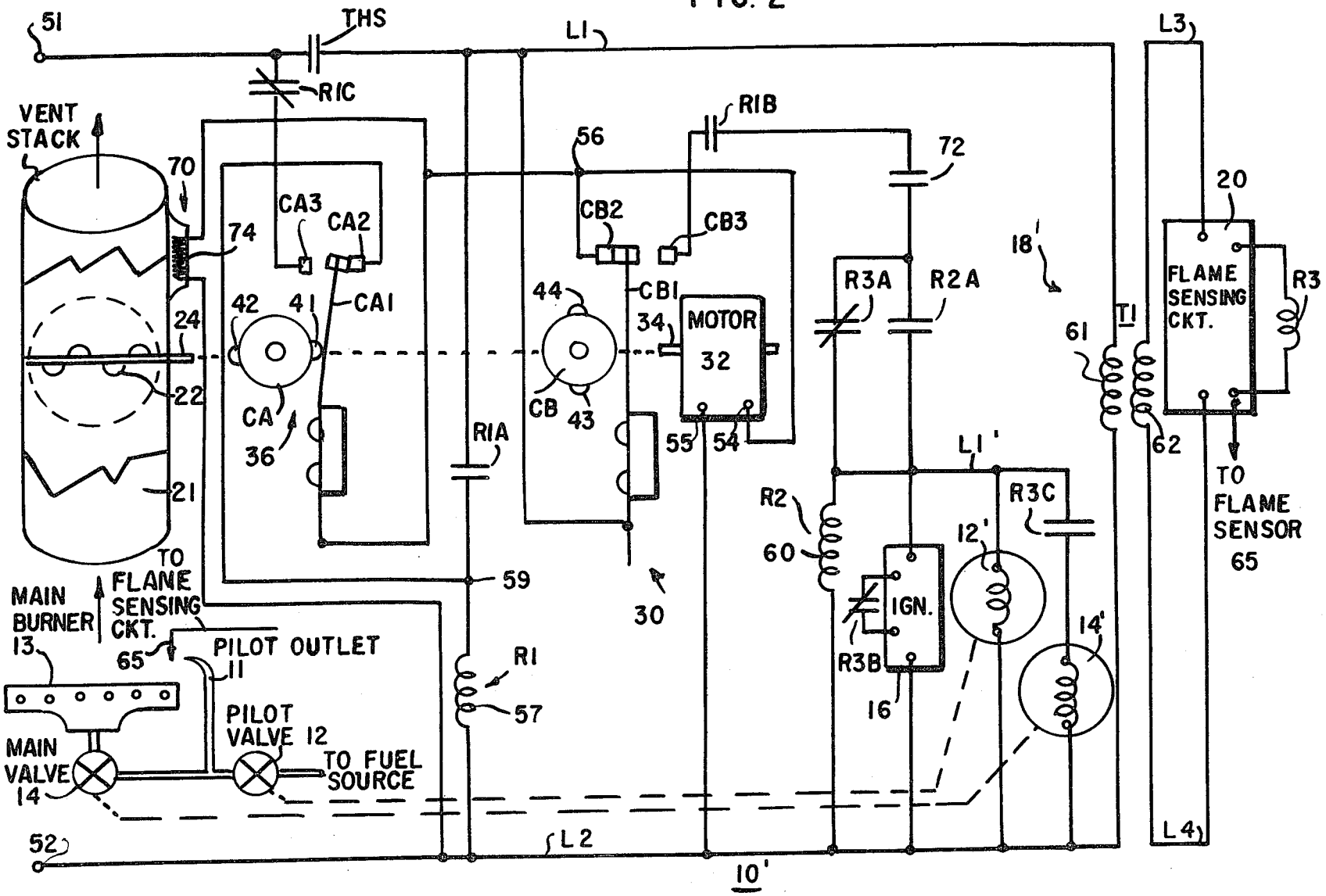

Referring to FIG. 2, there is shown a simplified representation of a heating system 10' employing a control arrangement provided in accordance with a second embodiment of the invention. The heating system 10' shown in FIG. 2 is generally similar to the system 10 shown in FIG. 1, and accordingly, corresponding elements have been given like reference numerals.

The heating system 10' includes a fuel ignition control circuit 18' which controls the operation of fuel valves 12 and 14, and a stack damper control circuit 30, including a drive motor 32 for driving damper plate 22 located in the vent stack 21 between open and closed positions, and controlling the operation of limit switches 36 and 38 for effecting the energization of the fuel ignition control circuit 18' in the manner described above for the heating system 10.

The fuel ignition control circuit 18' further includes a heat sensor switch 70 which responds to loss of main burner heat to deenergize the fuel ignition control circuit 18', preventing operation of the main valve 14 under certain failure conditions. In particular, the heat sensor switch 70 effects the deenergization of the fuel ignition control circuit 18' for an unsafe failure in the flame sensing circuit 20 during a heating cycle, followed by a flame-out or fuel interuption, thereby preventing the supply of fuel to the main burner in the absence of a pilot flame and with the igniter circuit 16 disabled.

More specifically, the heat sensor switch 70 comprises a thermal time delay relay, such as the Klixon Type A 60701 series. The switch 70, which may be mounted integral with the vent stack 21, as shown in FIG. 2, in the heat exchanger, or adjacent the main burner 13, responds to heat from the main burner to control the operation of associated contacts 72. The contacts 72 are connected in series with contacts R1B of the interlock relay R1 and contacts R3A of relay R3, in the energizing path for the fuel ignition control circuit 18'.

The switch 70 has an internal heater 74 which has one side connected to fixed contact CB2 of limit switch 38 and its other side connected to conductor L2, permitting the heater 74 to be energized over limit switch 38 at the start of each heating cycle, and after a heating time of approximately 15 seconds, causes contacts 72 to close. The heater 74 is deenergized when limit switch 38 operates to energize the fuel ignition control circuit 18'. At such time, the heater 74 maintains the contacts 72 closed for a predetermined duration to permit fuel supplied to the main burner 13 to be lit. When the main burner flame is established, heat from the main burner 13 maintains the contacts 72 closed. In the absence of the main burner heat, heater 74 cools down, and after a predetermined cooling time, which may be two minutes for a one-minute heating time for the heater element 74, the contacts 72 open, deenergizing the fuel ignition control circuit 18'.

Considering the operation of the heating system 10', when contacts THS close in response to a request for heat, the drive motor 32 is energized over limit switch 38 and effects rotation of the damper plate 22 towards the open position. Relay R1, which is energized over limit switches 36 and 38, operates to close contacts R1B to prepare an energizing path for the fuel ignition control circuit 18'. The heater element 74 of switch 70 is also energized over limit switch 38, and after a predetermined heating time effects the closing of contacts 72, permitting energization of the fuel ignition control circuit 18' to be effected over the limit switch 38 and contacts R1B and R3A in the manner described above for heating system 10.

Accordingly, with contacts 72 closed, then when the damper plate 22 has been driven to the fully open position, limit switch 38 operates to energize the fuel ignition control circuit 18', permitting the pilot valve 12 to supply fuel to the pilot outlet 11 for ignition by sparks provided by the igniter circuit 16. Following ignition of the pilot fuel, the flame sensing circuit 20 effects the energization of the main valve 14 which operates to supply fuel to the main burner 13 for ignition by the pilot flame. The heater element 74, is deenergized when limit switch 38 operates, and begins to cool down. However, when the main burner flame is established, heat from the main burner 13 passing out the vent stack 21 maintains contacts 72 of the heat sensor switch 70 closed.

If for any reason the main burner is not lit at the end of the cooling time for the heater 74, contacts 72 open, deenergizing the fuel ignition control circuit 18', permitting the fuel valves 12 and 14 to close.

At the end of a successful heating cycle, contacts THS open to deactivate the system 10' and permit the damper plate 22 to be returned to the closed position as described above. When the main burner flame is extinguished, the heat sensor switch 70 begins to cool down and, after a predetermined cooling time, permits contacts 72 to open, and the system 10' is prepared for the next heating cycle.

In the event of a successful start-up followed by an unsafe failure in the flame sensing circuit 20, followed by a flame out or fuel interruption, the main valve 14 may continue to supply fuel to the main burner. However, the main burner and the exhaust stack 21 begin to cool down due to the loss of main burner flame, permitting the heat sensor switch 70 to cool down. After the cooling time for the switch 70, the contacts 72 of the heat sensor 70 open, interrupting the energizing path for the fuel ignition control circuit 18', causing the fuel valves 12 and 14 to closed interrupting the supply of fuel to the main burner and the pilot outlet. Thus, the heat sensor switch 70 in effect acts as a back-up flame sensor which deactivates the system 10' in the event of the simultaneous failure conditions referred to above, or for failure of the main burner to be lit within a predetermined time following the operation of contacts THS in response to a request for heat.

I claim:

1. In a heating system including a furnace having a fuel fired burner apparatus, fuel supply means operable when energized to supply fuel to said burner apparatus for combustion to provide heat, a vent stack for conducting combustion products away from said burner apparatus, and stack damper means including a stack damper plate pivotally mounted within said vent stack, said damper plate being normally maintained in a first position to close said vent stack and being rotatable to a second position to open said vent stack, and a drive motor operatively coupled to said damper plate for driving said damper plate between said first and second positions, a control arrangement comprising switching means operable when energized to prepare an energizing path for said fuel supply means, first limit switch means connected in an energizing path for said drive motor to permit energization of said drive motor whenever said damper plate is at said first position, second limit switch means connected in series with said first limit switch means in an energizing path for said switching means to permit energization of said switching means whenever said damper plate is at said first position, activate means responsive to a request for heat to effect the energization of said switching means and said drive motor over said energizing path including said first limit switch means, when said damper plate is at said first position to permit said damper plate to be driven towards said second position, said second limit switch means being operated as said plate is driven away from said first position to interrupt said energizing path for said switching means whereby said second limit switch means prevents said switching means from responding to said activate means whenever said damper plate is at a position other than said first position, said first limit switch means being operable when said damper plate has been driven to said second position to interrupt said second energizing path and to complete said energizing path for said fuel supply means to effect energization of said fuel supply means, said activate means being operable when the heating demand has been met to deenergize said fuel supply means and said switching means, permitting said drive motor to be reenergized over a return path to drive said damper plate to said first position, said second limit switch means being operable when said damper plate has been driven to said first position to interrupt said return drive path to effect the deenergization of said drive motor, said switching means including a heat-sensor switch responsive to said activate means to permit the energization of said fuel supply means over said the energizing path for said fuel supply means, said heat sensor switch being operable in the absence of heat from said main burner apparatus within a predetermined interval of time following the energization of said fuel supply means to interrupt the energizing path for said fuel supply means.

2. A system as set forth in claim 1 wherein said heat sensor switch includes normally open contacts connected in said energizing path for said fuel supply means and a heater element energized over said first limit switch means responsive to said activate means to cause said contacts to close, said heater element being deenergized when said first limit switch means is operated whereby said heat sensor switch maintains said contacts closed responsive to heat from said burner apparatus, said heat sensor switch being operable in the absence of heat from said burner apparatus within a predetermined interval of time following deenergization of said heater element to open said contacts to thereby deenergize said fuel supply means.

3. In a heating system including a furnace having a fuel fired burner apparatus, fuel supply means including pilot valve means operable when energized to supply fuel to a pilot outlet for ignition, and main valve means operable when energized to supply fuel to said burner apparatus for ignition by the pilot flame, a vent stack for conducting combustion products away from said burner apparatus, and stack damper means including a stack damper plate pivotally mounted within said vent stack, said damper plate being normally maintained in a first position to close said vent stack and being rotatable to a second position to open said vent stack, and a drive motor operatively coupled to said damper plate for driving said damper plate between said first and second positions, a control arrangement comprising switching means, first limit switch means connected in an energizing path for said switching means and said drive motor to permit energization of said switching means and said drive motor over said energizing path whenever said damper plate is at said first position, activate means responsive to a request for heat to effect the energization of said switching means and said drive motor over said energizing path, including said first limit switch means, when said damper is at said first position to permit said damper plate to be driven towards said second position, said switching means being operable when energized to prepare an energizing path for said fuel supply means, and to provide a holding path for said switching means, said first limit switch means being operable when said damper plate has been driven to said second position to interrupt said energizing path for said switching means and said motor drive and to complete said energizing path for said fuel supply means, said pilot valve means being connected to said energizing path for said fuel supply means for operation whenever said energizing path for said fuel supply means is completed, said fuel supply means including flame sensing means having a first switching device operable when energized to interrupt the energizing path for said fuel supply means, said fuel supply means including a second switching device connected to said energizing path for said fuel supply means and normally operable prior to operation of said first switching device to provide a holding path for said pilot valve means, said first switching device being operable to connect said main valve means to said holding path for operation, said activate means being operable when the heating demand has been met to deenergize said fuel supply means and said switching means, permitting said drive motor to be reenergized over a return drive path to drive said damper plate to said first position, and second limit switch means operable when said damper plate has been driven to said first position to interrupt said return drive path to effect the deenergization of said drive motor.

4. A system as set forth in claim 3 wherein said flame sensing means is energized responsive to said activate means, said first energizing path for said fuel supply means being interrupted by said switching device, preventing energization of said fuel supply means in the event said first switching device operates prior to said second switching device.

5. In a heating system including a furnace having a fuel-fired burner apparatus, fuel supply means operable when energized to supply fuel to said burner apparatus for combustion to provide heat, a vent stack for conducting combustion products away from said burner apparatus, and stack damper means including a drive motor, and a damper plate pivotally mounted within said vent stack, said damper plate being normally maintained at a first position to close said vent stack and being rotatable to a second position to open said vent stack, said drive motor being operatively coupled to said damper plate for driving said damper plate between said first and second positions, a control arrangement comprising switching means first limit switch means having first contacts for controlling the energization of said drive motor and second contacts for controlling the energization of said fuel supply means, said first limit switch means being coupled to said stack damper means and operated thereby to close said first contacts to complete an energizing path for said drive motor and to open said second contacts to prevent energization of said fuel supply means whenever said damper plate is at said first position, and second limit switch means having third contacts for controlling the energization of said switching means and fourth contacts connected in a return drive path for said drive motor, said second limit switch means being coupled to said stack damper means and operated thereby to close said third contacts to connect said switching means to said energizing path for said drive motor, providing an energizing path for said switching means over said first and second limit switch means, and to open said fourth contacts to interrupt said return drive path when said damper plate is at said first position, activate means for connecting power to said energizing paths to effect energization of said switching means and said drive motor in response to a request for heat, said switching means being operable when energized to complete an energizing path for said duel supply means and to provide a holding path for said switching means, said drive motor being operable when energized to drive said damper plate from said first position to said second position, said stack damper means operating said second limit switch means to close said fourth contacts and to open said third contacts to interrupt said energizing path for said switching means when said damper plate is driven away from said first position, whereby said switching means is maintained energized over said holding path, and said stack damper means operating said first limit switch means when said damper plate has been driven to said second position to open said first contacts to interrupt said energizing path for said drive motor to deenergize said drive motor and to close said second contacts to connect power to said energizing path for said fuel supply means to effect energization of said fuel supply means, said fuel supply means and said switching means being deenergized when the heating demand has been met, permitting said drive motor to be reenergized over said return drive path including said fourth contacts of said second limit switch means to cause said damper plate to be driven to said first position, said stack damper means operating said second limit switch means to open said fourth contacts to interrupt said return drive path when said damper plate has been driven to said first position to deenergize said drive motor.

6. A system as set forth in claim 5 wherein said first limit switch means has a first actuator means coupled to said drive motor for operating said first and second contacts, and wherein said second limit switch means has a second actuator means coupled to said drive motor for operating said third and fourth contacts.

7. A system as set forth in claim 6 wherein said first actuator means includes a first cam member coupled to said drive motor and operable to permit said first contacts to be maintained normally closed and said second contacts to be maintained normally open when said damper plate is at said first position, and for opening said first contacts and closing said second contacts when said damper plate is at said second position, and said second actuator means includes a second cam member coupled to said drive motor and operable to maintain said third contacts normally closed and said fourth contacts normally open when said damper plate is at said first position, and for permitting said third contacts to open and said fourth contacts to close when said damper plate is at said second position.

8. A system as set forth in claim 7 wherein said first and second contacts are operated by a common switch member whereby the energization of said switching means and said drive motor is prevented in the event of a malfunction of said first limit switch means which allows said first contacts to be open when said damper plate is at said first position.

9. A system as set forth in claim 5 wherein said switching means comprises a switching device having normally open contacts connected in said energizing path for said fuel supply means and normally closed contacts connected in said return drive path for said drive motor.

10. A system as set forth in claim 5 wherein said switching device comprises a relay having said normally open contacts and said normally closed contacts operated by a common armature whereby said normally closed contacts are prevented from reclosing whenever said normally open contacts are welded together, thereby preventing the reenergization of said drive motor so that said damper plate is maintained at said second position.

11. In a heating system including a furnace having a fuel fired burner apparatus, fuel supply means operable when energized to supply fuel to said burner apparatus for combustion to provide heat, a vent stack for conducting combustion products away from said burner apparatus, and stack damper means including a stack damper plate pivotally mounted within said vent stack, said damper plate being normally maintained in a first position to close said vent stack and being rotatable to a second position to open said vent stack, and a drive motor operatively coupled to said damper plate for driving said damper plate between said first and second positions, a control arrangement comprising activate means responsive to a request for heat to energize said drive motor to permit said damper plate to be driven to said second position, switching means including a heat sensor switch energized by said activate means to prepare an energizing path for said fuel supply means, limit switch means operable when said damper plate has been driven to said second position to deenergize said motor and to complete said energizing path for said fuel supply means, said heat sensor switch being responsive to heat from said burner apparatus to maintain said energizing path until the heating demand has been met, said limit switch means being operable in response to said drive motor driving said damper plate to said second position to deenergize said heat sensor switch to permit said heat sensor switch to interrupt said energizing path after a predetermined time interval in the absence of heat from said burner apparatus within said predetermined time interval, said activate means being operable when the heating demand has been met to deenergize said fuel supply means, and to effect the reenergization of said drive motor, permitting said damper plate to be returned to said first position.

12. A system as set forth in claim 11 wherein said heat sensor switch includes normally open contacts connected in said energizing path for said fuel supply means, and a heater element energized over said limit switch means responsive to said activate means to cause said contacts to close, said heater element being deenergized when said limit switch means is operated whereby said heat sensor switch maintains said contacts closed responsive to heat from said burner apparatus, said heat sensor switch being operable in the absence of heat from said burner apparatus within a predetermined interval of time following deenergization of said heater element to open said contacts to thereby deenergize said fuel supply means.

13. A system as set forth in claim 11 wherein said heat sensor switch is mounted in said vent stack.

14. In a heating system including a furnace having a fuel fired burner apparatus, fuel supply means operable when energized to supply fuel to said burner apparatus for combustion to provide heat, a vent stack for conducting combustion products away from said burner apparatus, and stack damper means including a drive motor, and a stack damper plate pivotally mounted within said vent stack, said damper plate being normally maintained in a first position to close said vent stack and being rotatable to a second position to open said vent stack, said drive motor being operatively coupled to said damper plate for driving said damper plate between said first and second positions, a control arrangement comprising switching means, first limit switch means coupled to said stack damper means and operated thereby to complete an energizing path for said drive motor to permit energization of said drive motor whenever said damper plate is at said first position, and second limit switch means coupled to said stack damper means and operated thereby to connect said switching means to said energizing path for said drive motor, providing an energizing path for said switching means over said first and second limit switch means when said damper plate is at said first position, activate means responsive to a request for heat for connecting power to said energizing paths to effect the energization of said switching means and said drive motor, said switching means being operable when energized to complete an energizing path for said fuel supply means and to provide a holding path for said switching means, said drive motor being operable when energized to drive said damper plate from said first position towards said second position, said stack damper means operating said second limit switch means to interrupt said energizing path for said switching means when said damper plate is driven away from said first position, whereby said switching means is maintained energized over said holding path, and said stack damper means operating said first limit switch means when said damper plate has been driven to said second position to interrupt said energizing path for said drive motor to deenergize said drive motor and to connect power to said energizing path for said fuel supply means to effect energization of said fuel supply means, said activate means being operable when the heating demand has been met to deenergize said fuel supply means and said switching means, permitting said drive motor to be reenergized over a return drive path to drive said damper plate to said first position, and said stack damper means operating said second limit switch means when said damper plate has been driven to said first position to interrupt said return drive path to effect the deenergization of said drive motor.

15. A system as set forth in claim 14 wherein, in the event of a power interruption after said damper plate has been driven to said second position, said switching means is effective to interrupt said energizing path for said fuel supply means and to prepare said return drive path for said drive motor, permitting said drive motor to be reenergized when power is restored, causing said damper plate to be driven to said first position while maintaining said fuel supply means deenergized.

16. A system as set forth in claim 14 wherein said switching means comprises a switching device operable when energized to close first contacts to prepare said energizing path for said fuel supply means and to close second contacts to provide a holding path for maintaining said switching device energized when said second limit switch means operates.

17. A system as set forth in claim 16 wherein said second limit switch means is operable to prepare said return drive energizing path for said motor when said damper plate is driven to said second position, said switching device having third normally closed contacts connected in said return drive path to interrupt said return drive path when said switching device is energized, said return drive path being completed by said third contacts when said switching device is deenergized, and said second limit switch means being operated to interrupt said return drive path for said motor when said damper plate is driven to said first position.

18. A system as set forth in claim 17 wherein said first and third contacts are operated by a common armature whereby said third contacts are prevented from reclosing in the event said first contacts become welded together, thereby preventing said damper plate from being returned to said first position.

19. A system as set forth in claim 14 wherein said first and second limit switch means are coupled to said drive motor for operation thereby.

20. In a heating system including a furnace having a fuel-fired burner apparatus, fuel supply means operable when energized to supply fuel to said burner apparatus for combustion to provide heat, a vent stack for conducting combustion products away from said burner apparatus, and stack damper means, including a damper plate pivotally mounted within said vent stack, said damper plate being normally maintained at a first position to close said vent stack and being rotatable to a second position to open said vent stack, and a drive motor operatively coupled to said damper plate for driving said damper plate between said first and second positions, a control arrangement comprising switching means operable when energized to prepare an energizing path for said fuel supply means and a holding path for said switching means, stack damper control means including first limit switch means having first contacts connected in an energizing path for said drive motor, and second contacts connected in an energizing path for said fuel supply means, and a first actuator means including a first cam member coupled to said drive motor and operable to permit said first contacts to be maintained closed and said second contacts to be maintained open, providing an energizing path for said drive motor when said damper plate is at said first position to permit said drive motor to be energized in response to a request for heat, second limit switch means having third contacts connected in series with said first contacts in an energizing path for said switching means, and fourth contacts connected in a return drive path for said drive motor, and a second actuator means including a second cam member coupled to said drive motor and operable to maintain said third contacts closed and said fourth contacts open when said damper plate is at said first position, permitting energization of said switching means over a path including said first and third contacts in response to a request for heat, said drive motor being operable when energized to drive said damper plate from said first position to said second position, said second limit switch means being operated to open said third contacts and close said fourth contacts when said damper plate is driven away from said first position to interrupt said energizing path for said switching means whereby said switching means is maintained energized over said holding path, and said first limit switch means being operated when said damper plate has been driven to said second position to open said first contacts and to close said second contacts to interrupt said energizing path for said drive motor to deenergize said drive motor and to complete said energizing path for said fuel supply means, said third and fourth contacts being operated by a common switch member whereby the energization of said switching means is prevented, thereby preventing the energization of said fuel supply means in the event of a malfunction of said second limit switch means which permits said third contacts to be open when said damper plate is at said first position, said fuel supply means and said switching means being deenergized when the heating demand has been met, permitting said drive motor to be reenergized over said return drive path, including said fourth contacts, to cause said damper plate to be driven to said first position, said second limit switch means being operated when said damper plate has been driven to said first position to open said fourth contacts to deenergize said drive motor.

* * * * *

UNITED STATES PATENT AND TRADEMARK OFFICE

CERTIFICATE OF CORRECTION

PATENT NO. : 4,087,045

DATED : May 2, 1978

INVENTOR(S) : Russell Byron Matthews

It is certified that error appears in the above-identified patent and that said Letters Patent are hereby corrected as shown below:

Column 13, line 46, cancel "said"second occurrence;

Column 14, line 57, cancel "first";

Column 15, line 7, insert a comma before "first";

Column 15, line 32, "duel" should be -- fuel --;

Column 16, line 14, "7" should be -- 20 --;

Column 16, line 27, "5" should be -- 9 --.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*